United States Patent [19]

Tomita

[11] Patent Number: 4,541,324

[45] Date of Patent: Sep. 17, 1985

[54] VACUUM ACTUATOR WITH FAIL-SAFE SYSTEM

[75] Inventor: Kimio Tomita, Hachioji, Japan

[73] Assignee: Nissan Motor Company, Ltd., Japan

[21] Appl. No.: 659,353

[22] Filed: Oct. 10, 1984

[30] Foreign Application Priority Data

Oct. 31, 1983 [JP] Japan ..... 58-202892

[51] Int. Cl.[4] ..... F15B 13/044; F15B 9/10; F01B 19/00

[52] U.S. Cl. ..... 91/392; 91/49; 91/376 R; 91/459; 92/94

[58] Field of Search ..... 91/49, 376 R, 392, 459, 91/52; 92/94

[56] References Cited

U.S. PATENT DOCUMENTS

| | | | |
|---|---|---|---|
| 3,448,659 | 6/1969 | Beatenbough et al. | 91/49 |
| 4,189,981 | 2/1980 | Ludwig | 91/52 |
| 4,388,856 | 6/1983 | Cook | 91/376 R |

FOREIGN PATENT DOCUMENTS 58-214003 12/1983 Japan .

*Primary Examiner*—Paul E. Maslousky

*Attorney, Agent, or Firm*—Lowe, King, Price & Becker

[57] ABSTRACT

A vacuum responsive switch for detecting a failure in creation of a control vacuum within the control diaphragm chamber. A solenoid valve is provided which functions to equalize pressure within one of a power diaphragm chamber and a leak chamber with the other when vacuum represented by a signal from the vacuum responsive switch is lower than a predetermined value.

5 Claims, 3 Drawing Figures

VACUUM ACTUATOR WITH FAIL-SAFE SYSTEM

BACKGROUND OF THE INVENTION

1. Field of the Invention

The present invention relates to a vacuum actuator and more particularly to a vacuum actuator with a fail-safe system.

2. Description of the Prior Art

Vacuum actuators are well known and frequently used as a source of drive for various equipment used in automotive vehicles. One example is illustrated in FIG. 1. Referring to FIG. 1, the known vacuum actuator is provided with a power diaphragm 1 and a control diaphragm 2 having a small diameter as compared to the power diaphragm 1. The power diaphragm 1 and the control diaphragm 2 are mounted within an actuator housing and cooperates with each other to define therebetween a leak or atmospheric chamber 5. The power diaphragm 1 defines on the opposite side of the atmospheric chamber 5 a power diaphragm or servo chamber 3, while the control diaphragm 2 defines on the opposite side of the atmospheric chamber 5 a control diaphragm chamber 4.

Secured to the power diaphragm 1 is a push rod 6 which is supported by bearings 7 and 8 and extends through an air seal 9. The push rod 6 is formed with a power vacuum controlling passage 10 which extends inwardly from an open end 10*a* thereof communicating with the leak chamber 5 and terminating in a radial hole communicating with the power diaphragm chamber 3. Mounted within the power diaphragm chamber 3 is a power diaphragm spring 11 which biases the power diaphragm 1 to the left as viewed in FIG. 1 and in turn the push rod 11 toward a retracted position thereof. Provided for the power diaphragm chamber 3 is a connector 12 which is coupled with a power vacuum conveying hose 13 leading from a source of power vacuum (for example, an intake manifold of an internal combustion engine). Provided for the leak chamber 5 is an atmospheric air admission or vacuum leaking connector 14 which is coupled with an atmospheric air conveying hose 15 leading from a source of atmosphere such as an air cleaner opening to the ambient atmosphere.

Fixed to the control diaphragm 2 is a valve element or valve seat 16. This valve seat 16 is arranged in face-to-face relationship with the open end 10*a* of the push rod 6. Mounted within the control diaphragm chamber 4 is a control diaphragm spring 17 which biases the control diaphragm 2 to the right as viewed in FIG. 1 and in turn the valve seat 16 toward the open end 10*a* of the push rod 6. Provided for the control diaphragm 4 is a connector 18 which is coupled with a control vacuum conveying hose 19 leading from a source of control vacuum.

In operation, a control vacuum which may be obtained, for example, by pressure regulation on duty control is admitted to the control diaphragm 4. This causes the control diaphragm 2 to move against the spring 17. With this movement of the control diaphragm 2, a clearance space between the valve seat 16 and the open end 10*a* of the power vacuum controlling passage 10 is adjusted, adjusting the flow of air from the leak chamber into the power diaphragm chamber 3, thus controlling the power vacuum within the power diaphragm chamber 3. The power diaphragm 1 moves against the spring 11 in response to the power vacuum therein, thus controlling the projected position of the push rod 6.

According to this known vacuum actuator, when the vacuum within the control diaphragm chamber 4 disappears, the valve seat 16 movable with the control diaphragm 2 blocks the power vacuum controlling passage 10, preventing a reduction in the vacuum within the power diaphragm chamber 3, thus allowing the push rod 6 to move with the power diaphragm 2 up to its full stroke projected position. Therefore, a problem presented by this known vacuum actuator is that the push rod 6 would move to its full stroked position and thus malfunction toward a danger side should the vacuum within the control diaphragm chamber 4 disappear owing to breakage of the actuator itself, removal of the control vacuum conveying hose 19, or breakage thereof.

SUMMARY OF THE INVENTION

An object of the present invention is to improve the vacuum actuator of the above type by providing a fail-safe system which is so designed that failure in normal operation of a valve element does not cause the push rod to move to its full stroke position.

According to the present invention, failure in normal operation of a valve element is detected, and upon detection of the failure, substantially the same pressure is rendered to prevail in both of a power diaphragm chamber and a leak chamber.

DESCRIPTION OF THE EMBDOIMENTS

Figure 1:
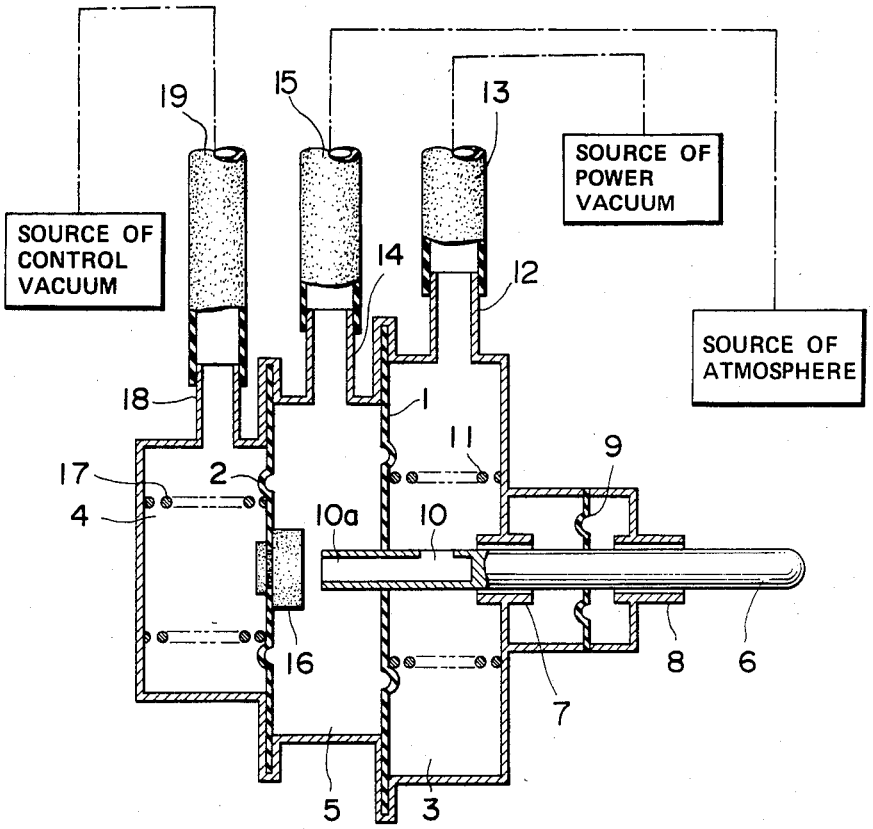
FIG.1 (PRIOR ART)
FIG. 1 is a longitudinal sectional diagrammatic view of the known vacuum actuator discussed above.
Figure 2:
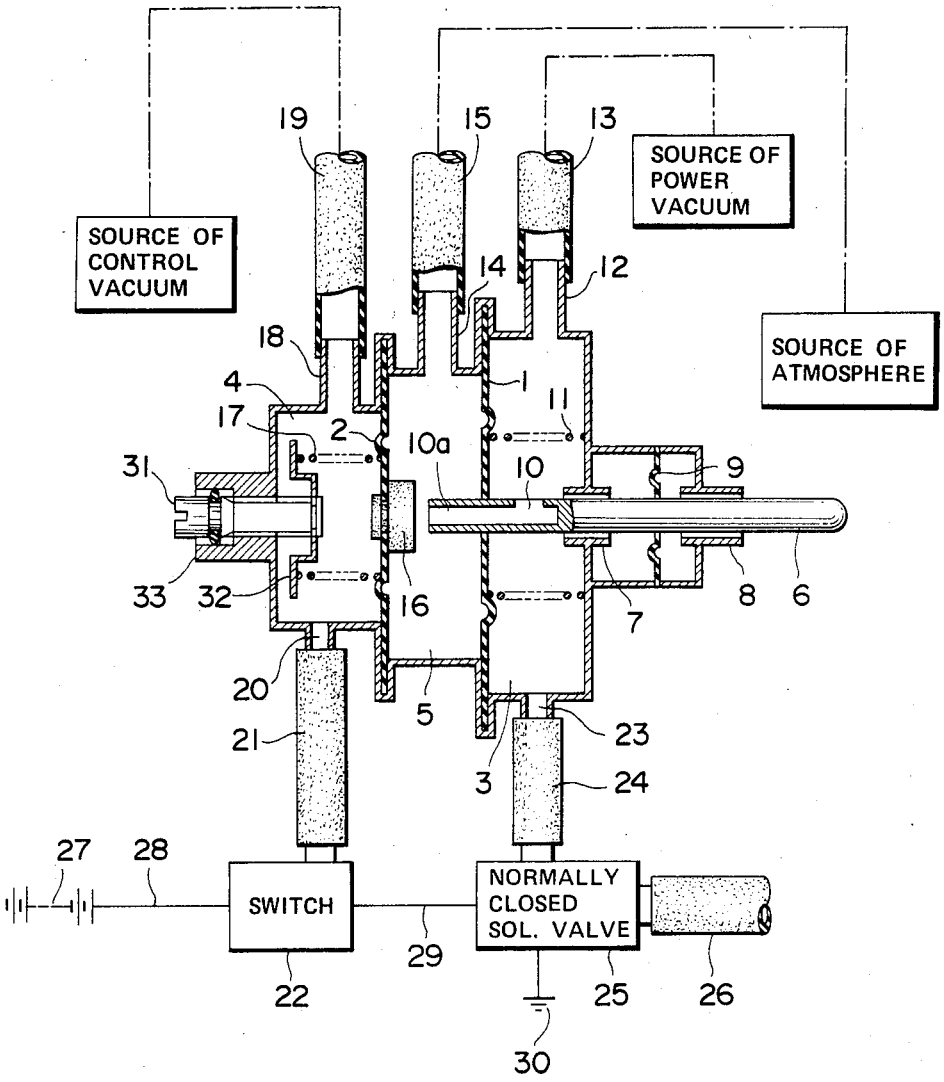
FIG. 2 is a longitudinal sectional diagrammatic view of a vacuum actuator with a first embodiment of a fail-safe system according to the present invention.

Referring to FIGS. 1 and 2, the same reference numerals are used to designate like parts. Referring to FIG. 2, the first embodiment is described which embodiment is similar to the known vacuum actuator shown in FIG. 1 but with the provision of a fail-safe system. The fail-safe system is described hereinafter.

Opening into a control diaphragm chamber 4 is a control vacuum detecting connector 20 which is coupled with one end of a vacuum detecting hose 21. The opposite end of the vacuum detecting hose 21 is connected to a pressure or vacuum chamber of a pressure responsive switch 22. The pressure responsive switch 22 is of the conventional type which is so constructed as to be closed when the vacuum admitted to the vacuum chamber thereof is lower than a predetermined value (for example, zero).

There is provided a power vacuum diluting connector 23 which communicates with a power diaphragm chamber 3. Coupled with this connector 23 is one end of a power vacuum diluting hose 24. The opposite end of the power vacuum diluting hose 24 is connectable via a normally closed solenoid 24 to an atmospheric air admitting hose 26.

The solenoid valve 25 is circuited via the pressure responsive switch 22 with a source of electric power. The reference numeral 28 designates an input lead line, the reference numeral 29 an output lead line, and the reference numeral 30 an earth line.

If the vacuum within the control diaphragm chamber 4 is reduced and disappears due to removal of the control vacuum conveying hose 19 or breakage thereof, this reduction in the vacuum is transmitted to the pressure responsive switch 22 via the control pressure detecting connector 20 and the hose 21, causing the pressure responsive switch 22 to be closed because the pressure responsive switch 22 is adapted to be closed responsive to vacuum below the predetermined value. The closure of the vacuum responsive switch 22 causes electric current from the source of electric power 27 to pass through the solenoid valve 25 via the input lead line 28 and the output lead line 29, thus urging the solenoid valve 25 to open. This causes the vacuum within the power diaphragm chamber 3 to be reduced by dilution by atmospheric air admitted by the atmospheric air admitting hose 26 via the power vacuum diluting connector 23, the hose 24 and the solenoid valve 25. Therefore, the vacuum within the power diaphragm chamber 3 disappears and thus becomes equal to that within the leak chamber 5. As a result, the push rod 6 is pulled back inwards by the power diaphragm spring 11, providing a safeguard against the push rod 6 moving to its full stroke position.

In this embodiment, a control diaphragm spring 17 which has one end bearing against a control diaphragm 2 has a opposite end supported by a spring retainer 32 attached to a leading end of an adjusting screw 31 that is threadedly engaged with a wall of an actuator housing. The reference numeral 33 designates an O-ring.

Thus, turning the adjusting screw 31 causes adjustment of the position of the spring retainer 32 relative to the control diaphragm 2, enabling easy adjustment of a set load of the control diaphragm spring 17, thus coping with a problem that the set load of the control diaphragm spring 17 varies from one product to another due to error that may take place during manufacturing. Therefore since the set load can be adjusted without any difficulty, a variation in relation of the stroke of the push rod 6 with the control vacuum is compensated for.

Figure 3:
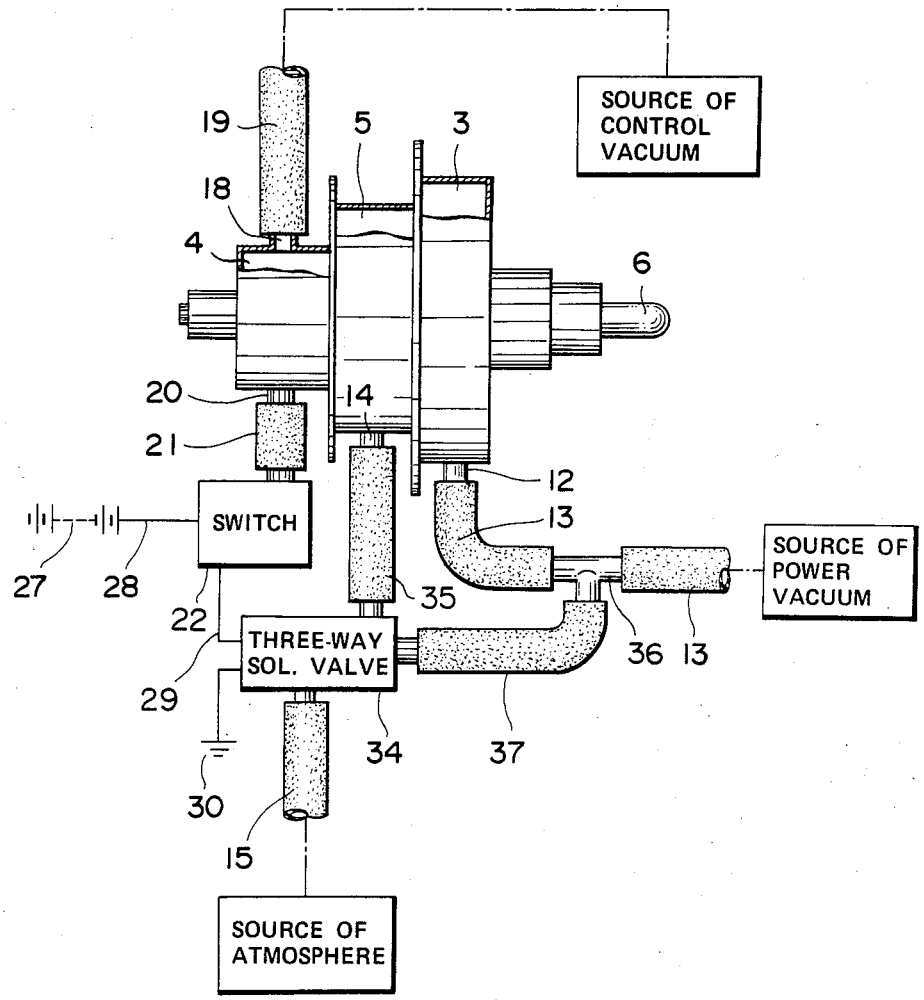
FIG. 3 is a perspective diagrammatic view of a vacuum actuator provided with a second embodiment of a fail-safe system according to the present invention.

Referring to FIG. 3, a second embodiment is described. This embodiment is substantially similar to the above mentioned first embodiment, but is different from the same in that upon detection of a failure in creation of a control vacuum, a power vacuum is created within a leak chamber.

Coupled with an atmospheric air admitting connector 14 communicating with a leak chamber 5 is a hose 35 from a three-way solenoid valve 34. Coupled with the three-way solenoid valve 34 is an atmospheric air conveying hose 15 communicating with a source of atmosphere. Also coupled with the three-way solenoid valve 34 is a branch hose 37 from a three-way or T-shaped connector 36 interposed in a power vacuum conveying hose 13 leading from a source of power vacuum.

When it is not energized, the three-way solenoid valve 34 connects the hose 35 only to the hose 15 to admit atmospheric air to the leak chamber 5, whereas when it is energized, it connects the hose 35 only to the branch passage 37 extending from the power vacuum conveying hose 13 to admit the power vacuum to the leak chamber 5. The three-way solenoid 34 is circuited with a vacuum responsive switch 22.

When the vacuum within the control diaphragm chamber 4 drops due to removal of the control vacuum conveying hose 19 or breakage thereof and the vacuum responsive switch 22 is closed, the electric current is supplied to the three-way solenoid valve 34. Then, the three-way solenoid valve 34 blocks the connection of the hose 35 with the atmospheric air admitting hose 15 and establishes the connection of the hose 35 with the branch hose 37 extending from the power vacuum conveying hose 13. As a result, the power diaphragm chamber 3 and the leak chamber 5 will have substantially the same pressure because the power vacuum is admitted to the leak chamber 5 also from the power vacuum conveying hose 13 via the three-way connector 36, branch hose 37, solenoid valve 34 and hose 35. For this reason, the push rod 6 is prevented from moving to its full stroke position, thus securing safety. In this embodiment, the push rod 6 takes an equlibrium position because the vacuum admitted to the leak chamber 5 acts on the control diaphragm 2.

From the above description, it will now be appreciated that the push rod is prohibited from moving to the full stroke projected position because upon detecting the failure in creation of the control vacuum within the control chamber, both the leak chamber and the power diaphragm chamber are supplied with substantially the same pressure.

What is claimed is:

1. A vacuum actuator comprising:

a housing;

a power diaphragm mounted within said housing and having one side defining a power diaphragm chamber and an opposite side defining a leak chamber;

a push rod fixedly connected to said power diaphragm and movable therewith;

a source of power vacuum connected with said power diaphragm chamber;

means for biasing said push rod and said power diaphragm toward said leak chamber;

means defining a passage having one end communicating with said power diaphragm chamber and an opposite end communicating with said leak chamber;

means, including a valve element cooperating with said passage, for controlling flow communication between said power diaphragm chamber and said leak chamber;

means for detecting a failure in normal operation of said flow communication controlling means and generating an output signal; and means responsive to said output signal for rendering substantially the same pressure to prevail in both of said power diaphragm chamber and said leak chamber.

2. A vacuum actuator as claimed in claim 1, wherein said flow communication controlling means includes a control diaphragm mounted within said housing and spaced from said power diaphragm and cooperating therewith to define said leak chamber therebetween, said control diaphragm having one side defining said leak chamber and an opposite side defining a control chamber within said housing; and a source of control vacuum connected with said control diaphragm chamber, said valve element being fixed to said control diaphragm and movable toward said opposite end of said passage, and means for biasing said valve element and said control diaphragm toward said opposite end of said passage to close the same.

3. A vacuum actuator as claimed in claim 2, wherein said detecting means includes a pressure responsive switch which is closed upon detection of the control vacuum within said control diaphragm chamber below a predetermined value.

4. A vacuum actuator as claimed in claim 1, wherein said rendering means includes a solenoid valve which connects said power diaphragm chamber with the ambient atmosphere to permit said power diaphragm chamber to communicate with said atmosphere when energized.

5. A vacuum actuator as claimed in claim 1, wherein said rendering means includes a three-way solenoid valve which blocks connection of said leak chamber with the ambient atmosphere and establishes connection of said leak chamber with said power diaphragm chamber when it is energized.

* * * * *